US011613970B2

(12) United States Patent
Ramirez et al.

(10) Patent No.: US 11,613,970 B2
(45) Date of Patent: Mar. 28, 2023

(54) LINER HANGER RUNNING TOOL WITH PRESET PROTECTION

(71) Applicants: Joseph Ramirez, Houston, TX (US); Frank Maenza, Houston, TX (US)

(72) Inventors: Joseph Ramirez, Houston, TX (US); Frank Maenza, Houston, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 135 days.

(21) Appl. No.: 16/951,138

(22) Filed: Nov. 18, 2020

(65) Prior Publication Data

US 2022/0154558 A1 May 19, 2022

(51) Int. Cl.

| | |
|---|---|
| ***E21B 43/10*** | (2006.01) |
| ***E21B 33/128*** | (2006.01) |
| ***E21B 23/00*** | (2006.01) |

(52) U.S. Cl.
CPC ..... *E21B 43/10* (2013.01); *E21B 23/00* (2013.01); *E21B 33/128* (2013.01)

(58) Field of Classification Search
CPC ..... E21B 43/10; E21B 23/00
See application file for complete search history.

(56) References Cited

U.S. PATENT DOCUMENTS

2020/0232293 A1 7/2020 Yee
2021/0363840 A1* 11/2021 Villegas ..... E21B 23/06

* cited by examiner

*Primary Examiner* — Yong-Suk (Philip) Ro
(74) *Attorney, Agent, or Firm* — Cantor Colburn LLP

(57) ABSTRACT

A liner hanger system includes a mandrel and an extension disposed radially outwardly of the mandrel at least in part. The extension is disposed to urge a seal/anchor to a set position. A running tool is disposed radially inwardly of the mandrel and a ring is resiliently engagable with the mandrel and the extension simultaneously upon being deflected radially outwardly by the running tool.

8 Claims, 7 Drawing Sheets

LINER HANGER RUNNING TOOL WITH PRESET PROTECTION

BACKGROUND

In the resource recovery industry, liner hanger running tools are well known. Liners are run with anchors and packers to a target depth and set there. There is a risk in some systems that a packer might set earlier than intended resulting in the liner potentially not being positioned or anchored properly. An example of subsurface conditions that increase the likelihood of preset are highly deviated and horizontal wells where a high amount of friction tends to be encountered during running. Such situations may require time and cost for repair and are therefore undesirable. The art would well appreciated systems and methods for ensuring presets do not occur with liner running tools

SUMMARY

An embodiment of a liner hanger system including a mandrel, an extension disposed radially outwardly of the mandrel at least in part, the extension disposed positioned and configured to urge a seal/anchor to a set position, a running tool disposed radially inwardly of the mandrel, a ring resiliently engagable with the mandrel and the extension simultaneously when deflected radially outwardly by the running tool.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

A well-known commercial product combination available from Baker Hughes Houston Tex. is known as Flex Lock V (hanger) and a ZXHD Liner Packer. Specific description of all elements of these tools is not necessary in this application since they are commercially available but reference to some of the components in order to describe differences in the invention will be employed.

Figure 1:
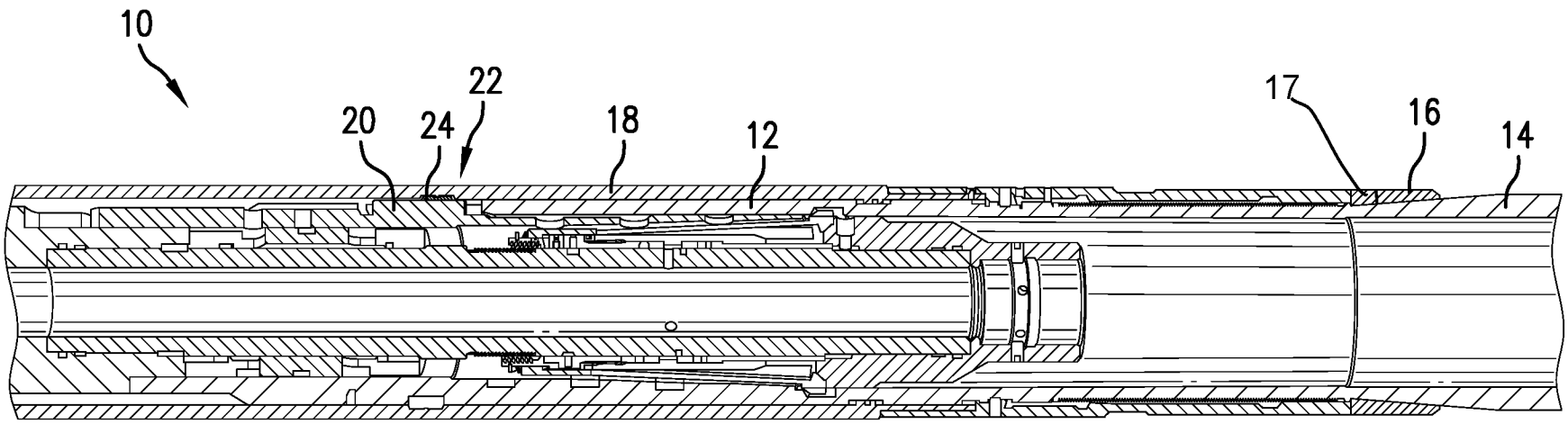
FIG. 1 is a sectional view of a liner hanger system disclosed herein in a run in position.

Referring to FIG. 1, a liner hanger system 10 is illustrated. The system 10 includes a mandrel 12 with a frustoconical segment 14 at a downhole end thereof. The frustoconical segment 14 is interactive with a seal 16, an anchor 17 or a seal and anchor (16 and 17) (hereinafter shorthandedly referred to as "seal/anchor 16/17") that is urged to a sealed position against a radially outwardly positioned tubular (not shown) when the seal/anchor 16/17 is set. The seal/anchor is by design, urged to expand on the frustoconical segment 14 when an extension 18 is urged downhole for the specific purpose of setting the seal/anchor 16/17. The problem of preset as mentioned above is occasioned by the extension becoming stuck in the radially outwardly positioned tubular (not shown) and caused to have relative motion with regard to the frustoconical segment 14 based upon uphole directed movement of a running tool 20 of the system 10 within the extension 18 during positioning of the liner (not shown). As one familiar with the commercial product will readily appreciate, it is this same relative movement between the extension 18 and the running tool 22 that is utilized to intentionally set the seal/anchor 16/17 but only after the liner is properly positioned and anchored and dogs (not shown) are radially outwardly expanded just uphole of the extension 18 to provide set down weight onto the extension 18. To avoid this problem, the inventors hereof have devised a lock system 22 that prevents relative movement between the extension 18 and the running tool 20 that maintains all other parameters of the system 10.

Figure 2:
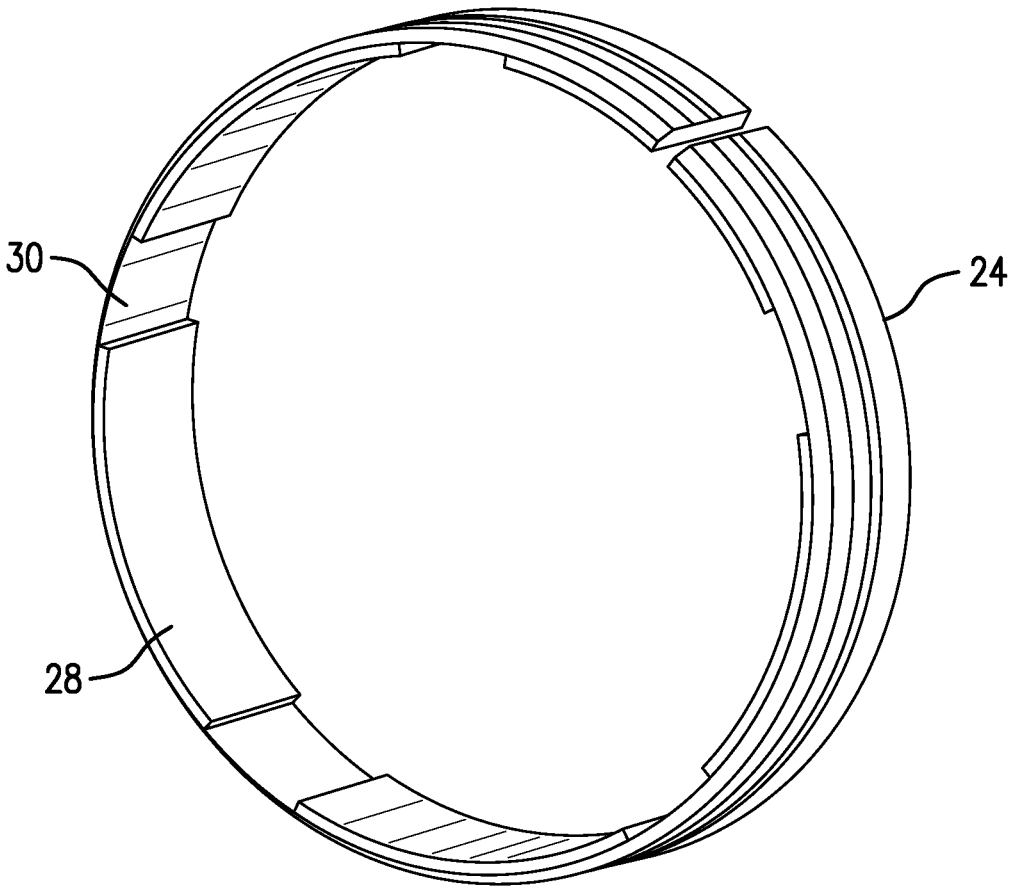
FIG. 2 is a perspective view of a ring that comprises a part of the system disclosed herein.
Figure 3:
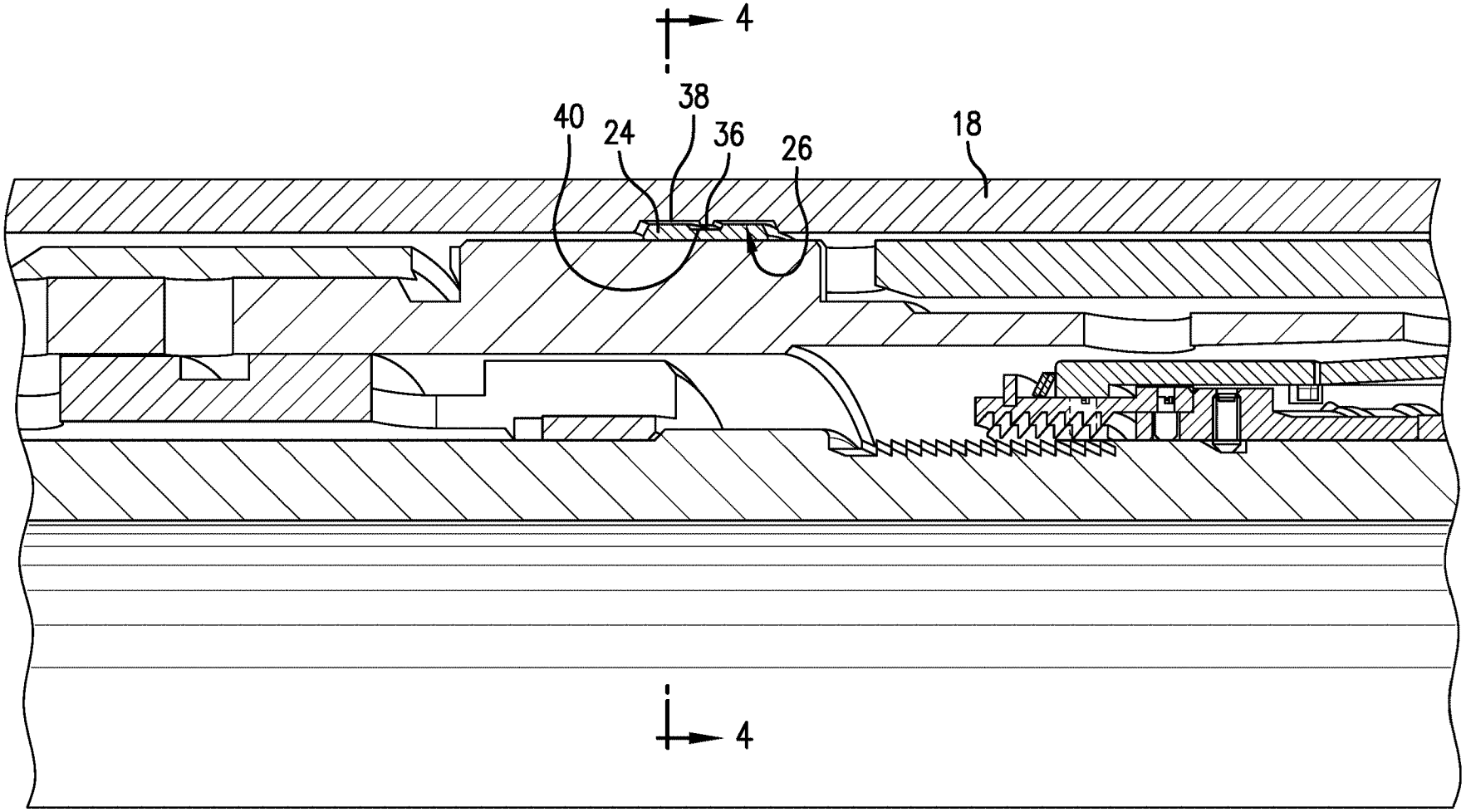
FIG. 3 is an enlarged view of a portion of FIG. 1.
Figure 4:
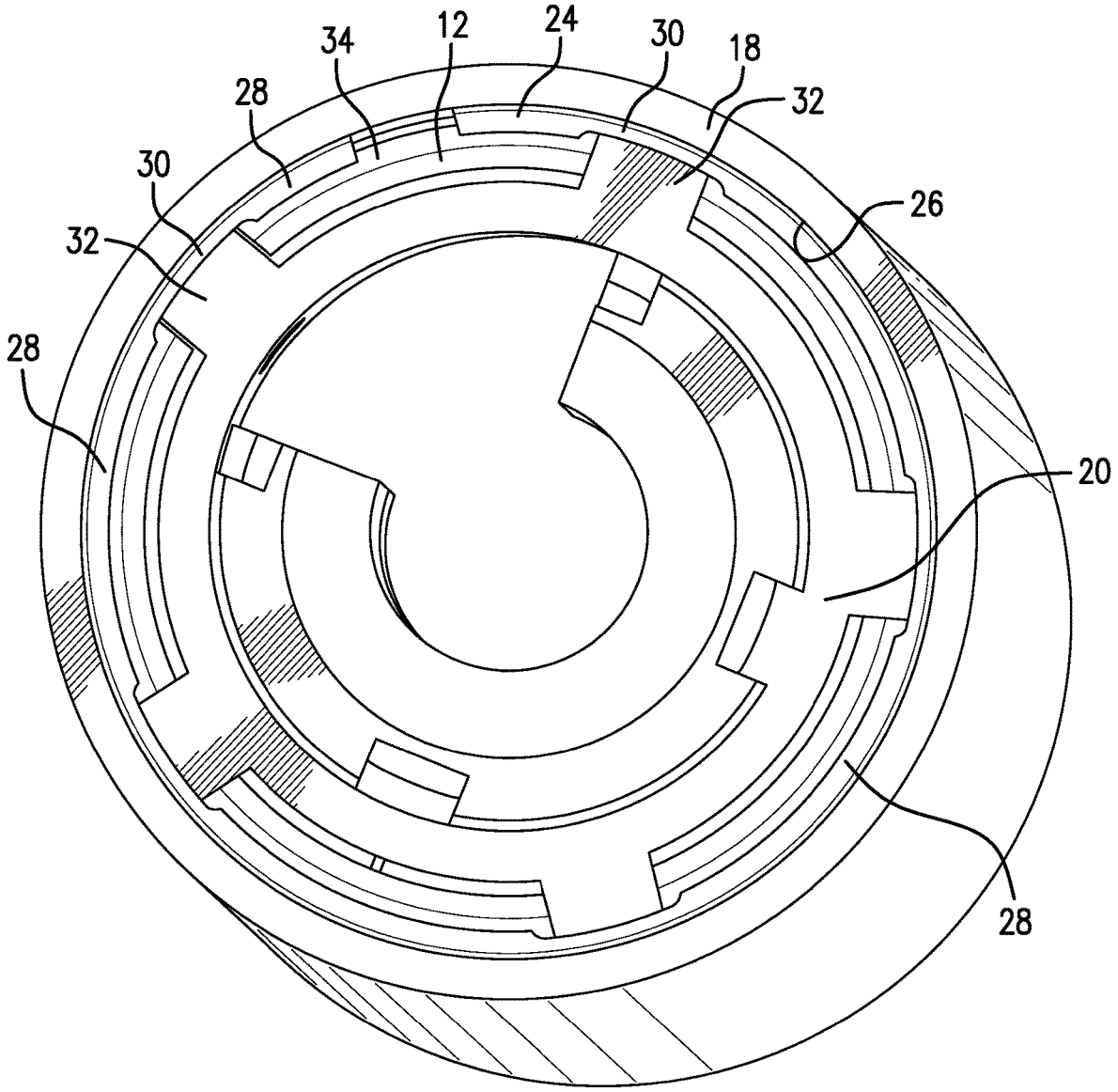
FIG. 4 is a section view of the system as illustrated in FIG. 3 and taken along section lines 4-4.

Referring to FIG. 2, the lock system 22 includes a specially configured snap ring 24. Referencing FIGS. 2-4 simultaneously, it will be appreciated how the ring 24 interacts with other components of system 10. The ring 24 is biased into engagement with a recess groove 26 of the extension 18 while remaining engaged with the mandrel 12 at radially relatively thicker portions 28. It should also be appreciated that in an embodiment, the radially relatively thinner portions 30 (relative to the radially thicker portions 28) of the ring 24 bridge over the full diameter of the running tool 20. Accordingly, in such embodiments the running tool 20 is not degraded by a groove and the running tool is easily displaced from under the ring 24 when the time for allowing the ring 24 to disengage from the extension 18 for setting of the seal/anchor 16/17 is reached. During running, the ring 24 is resiliently urged radially outwardly by the running tool 20 into engagement with the groove 26 on the extension 18 and yet still be engaged with the mandrel 12 at the inside diameter of the radially thicker portions 28. The condition is best seen in FIG. 4 once location and geometry of parts is established in the mind of the reader through review of FIGS. 2 and 3. Another way to describe the interaction of the ring 24 with the extension 18 and the running tool 20 is that the ring 24 while engaged with the groove 26 due to the biasing force of torque arms 32 of the running tool 20, the ring 24 also reaches radially inwardly (the thicker portions 28) in between the torque arms 32 to the mandrel 12 into a groove 34 in the mandrel 12. With the ring 24 engaged with both the groove 26 and the groove 34, the extension 18 cannot more axially relative to the mandrel 12. Upon movement of the running tool 20 in the uphole direction relative to the extension 18 and mandrel 12 however, the ring 24 will resiliently disengage with the groove 26 thereby freeing the extension 18 to move relative to the mandrel 12. This will return the system to the normal operation of the liner hanger running tool discussed above.

Figure 5:
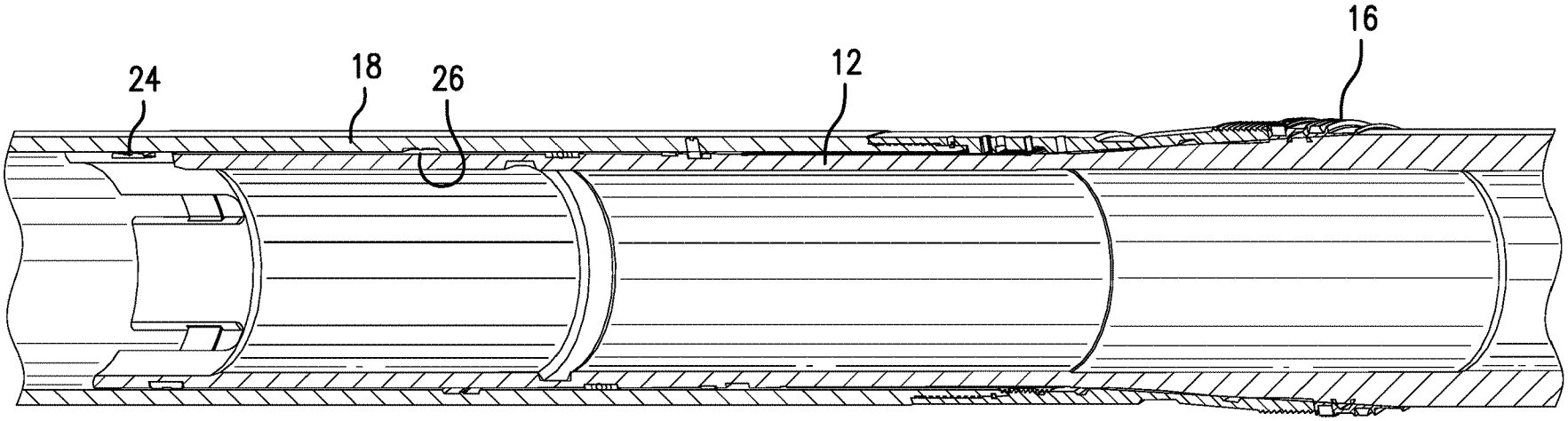
FIG. 5 is a section view of a portion of the components of liner hanger system disclosed herein after setting.

FIG. 5 illustrates the seal/anchor 16/17 in the set position having been radially outwardly expanded by axial movement along the frustocone 14. The movement is caused by the extension 18 having been moved downhole (to the right in the figure) relative to the mandrel 12. The figure retains the ring 24 now shown out of engagement with the groove 26 and remaining in engagement with groove 34 on mandrel 12.

Figure 6:
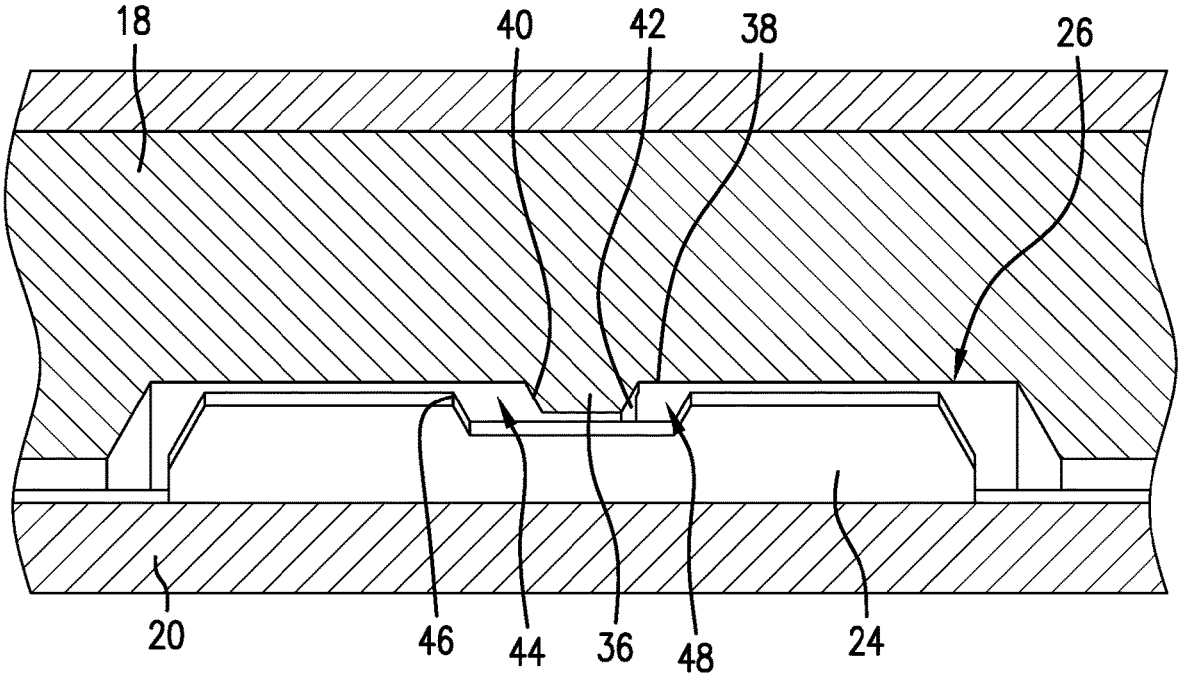
FIG. 6 is an enlarged view of an optional load feature.

In an embodiment, referring to FIG. 6, the groove 26 includes a load feature 36 that may be configured as a rib extending radially inwardly from a radially outermost surface 38 of the groove 26. The load feature 36 increases the resistance to movement of the extension 18 relative to the mandrel 12 due to the provision of additional surfaces 40 or 42 for interaction between the ring 24 and the groove 26. The load feature 36 extends into a relief 44 of ring 24, which provides counter faces 46 or 48 for additional surfaces 40 or 42, respectively, for load distribution.

Figure 7:
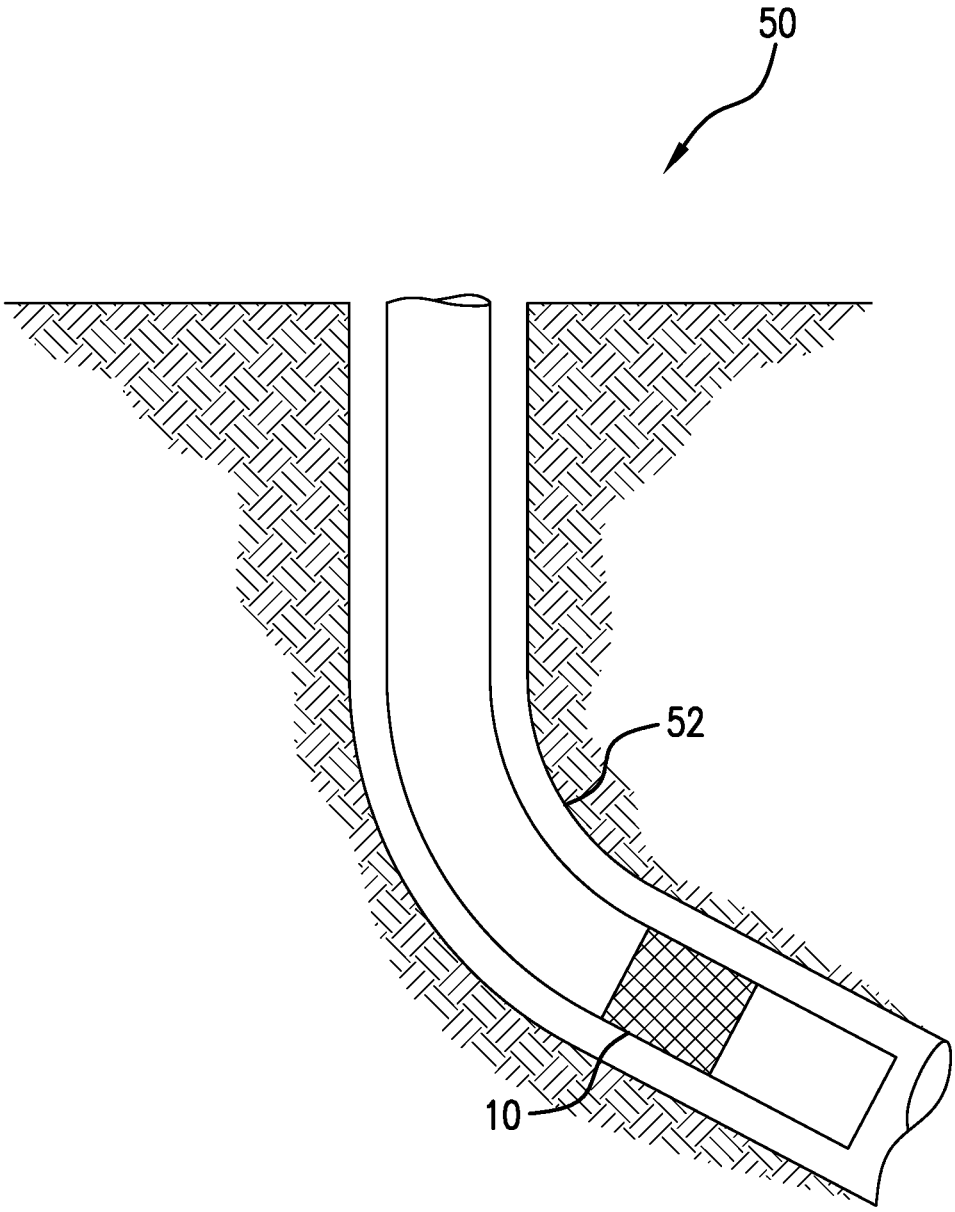
FIG. 7 is a schematic view of a wellbore system employing the liner hanger system disclosed herein.

Referring finally to FIG. 7, a wellbore system 50 is illustrated, the system 50 including a borehole 52 and a liner hanger system 10 disposed therein.

In use, the system 10 operates as follows: The liner hanger system 10 is run to depth with a liner (not shown) hanging downhole of the system 10. When the liner is at the designated location for setting of the seal/anchor 16/17, an anchor for the liner is separately set. The running tool 20 is then released from the mandrel 12 to move marginally uphole relative to the mandrel. This movement unsupports the ring 24 thereby allowing the ring 24 to resiliently move radially inwardly. The radially inward movement disengages the ring 24 from the groove 26 thereby allowing relative axial movement of the extension 18 relative to the mandrel 12. As noted above, this movement is what sets the seal/anchor 16/17. Once the seal/anchor 16 is set, the running tool 20 may be withdrawn from the wellbore system 50.

Set forth below are some embodiments of the foregoing disclosure:

Embodiment 1: A liner hanger system including a mandrel, an extension disposed radially outwardly of the mandrel at least in part, the extension disposed positioned and configured to urge a seal/anchor to a set position, a running tool disposed radially inwardly of the mandrel, a ring resiliently engagable with the mandrel and the extension simultaneously when deflected radially outwardly by the running tool.

Embodiment 2: The system as in any prior embodiment, wherein the ring is disposed about torque arms of the running tool.

Embodiment 3: The system as in any prior embodiment, wherein the ring includes relatively thicker portions and relatively thinner portions to engage the extension and the mandrel simultaneously.

Embodiment 4: The system as in any prior embodiment, wherein the extension includes a recess groove receptive to the ring while the ring is engaged with the mandrel.

Embodiment 5: The system as in any prior embodiment, wherein the recess groove includes a load feature.

Embodiment 6: The system as in any prior embodiment, wherein the load feature is a rib.

Embodiment 7: The system as in any prior embodiment, wherein the ring includes a relief configured to interact with the load feature.

Embodiment 8: A wellbore system including a borehole, and a liner hanger system as in any prior embodiment disposed therein.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A liner hanger system comprising:

a mandrel;

an extension disposed radially outwardly of the mandrel at least in part, the extension disposed positioned and configured to urge a seal or an anchor or a seal and anchor to a set position;

a running tool disposed radially inwardly of the mandrel;

a ring resiliently engagable with the mandrel radially inwardly and the extension radially outwardly simultaneously upon being deflected radially outwardly by the running tool.

2. The system as claimed in claim 1 wherein the ring is disposed about torque arms of the running tool.

3. The system as claimed in claim 1 wherein the ring includes relatively thicker portions and relatively thinner portions to engage the extension and the mandrel simultaneously.

4. The system as claimed in claim 1 wherein the extension includes a recess groove receptive to the ring while the ring is engaged with the mandrel.

5. The system as claimed in claim 4 wherein the recess groove includes a load feature.

6. The system as claimed in claim 5 wherein the load feature is a rib.

7. The system as claimed in claim 5 wherein the ring includes a relief configured to interact with the load feature.

8. A wellbore system comprising:

a borehole; and a liner hanger system as claimed in claim 1 disposed therein.

* * * * *